US008357017B2

(12) United States Patent
Xu et al.

(10) Patent No.: US 8,357,017 B2
(45) Date of Patent: Jan. 22, 2013

(54) ELECTRICAL CONNECTOR WITH IMPROVED CONTACTS

(75) Inventors: Feng Xu, Kunshan (CN); Xiang-Qi Yang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 149 days.

(21) Appl. No.: 12/892,926

(22) Filed: Sep. 29, 2010

(65) Prior Publication Data

US 2011/0076899 A1 Mar. 31, 2011

(30) Foreign Application Priority Data

Sep. 30, 2009 (CH) ..... 2009 2 0311931 U

(51) Int. Cl.
*H01R 4/48* (2006.01)

(52) U.S. Cl. ..... 439/862

(58) Field of Classification Search ..... 439/862, 439/856, 668, 748
See application file for complete search history.

(56) References Cited

U.S. PATENT DOCUMENTS

| | | | | |
|---|---|---|---|---|
| 5,997,363 | A * | 12/1999 | Joly | 439/748 |
| 6,923,687 | B2 | 8/2005 | Wang | |
| 7,628,630 | B2 * | 12/2009 | Chang | 439/862 |
| 2009/0004925 | A1 * | 1/2009 | Su et al. | 439/668 |

* cited by examiner

*Primary Examiner* — Felix O Figueroa
(74) *Attorney, Agent, or Firm* — Wei Te Chung; Ming Chieh Chang

(57) ABSTRACT

An electrical connector includes an insulating housing having a mating cavity and at least a contact retained in the housing. The contact defines a retaining portion, a resilient arm extending forwards from a front edge of the retaining portion and a soldering portion extending out of the housing. The resilient arm defines a contacting portion projecting into the mating cavity at a front end thereof and a skirt bending from a side edge of the resilient arm and angled with the resilient arm. The skirt provided in the resilient arm can enhance the rigidity of the contact.

18 Claims, 5 Drawing Sheets

ELECTRICAL CONNECTOR WITH IMPROVED CONTACTS

BACKGROUND OF THE INVENTION

1. Field of the Invention

The present invention relates to an electrical connector, and more particularly to an electrical connector having improved contacts which is reinforced with side skirt preventing the same from being crushed while mating with a mating connector.

2. Description of the Related Art

Electrical connector are typically used to interconnect two electronic devices, and for example, between a computer and a peripheral device. U.S. Pat. No. 6,923,687 issued to Wang on Aug. 2, 2005 discloses an electrical connector which defines an insulative housing and a plurality of terminals retained in the housing. The housing defines a base portion, a mating portion extending forwards from the base portion, a mating cavity recessed rearwards from a front face of the mating portion and a plurality of receiving grooves recessed forwards from a rear face of the base portion and communicating with the mating cavity. The plurality of terminals define an elastic contact having a retaining portion, an elastic arm extending forwardly from a front edge of the retaining portion and a soldering portion. The elastic contact is retained in a corresponding receiving groove with a front portion of the elastic arm projecting into the mating cavity for contacting with a mating connector. However, the elastic arm of the elastic contact has a comparable weak rigidity and may be vulnerably crushed while the mating connector frequently mating with the electrical connector or slantways inserted into the mating cavity to contact with the elastic arm. Hence, it is desired to provide an electrical connector to overcome the problems mentioned above.

SUMMARY OF THE INVENTION

An object of the present invention is to provide an electrical connector with improved contacts having enhanced rigidity by providing reinforced skirt along mating portion.

In order to achieve the above-mentioned object, an electrical connector includes an insulating housing having a mating cavity and at least a contact retained in the housing. The contact defines a retaining portion, a resilient arm extending forwards from a front edge of the retaining portion and a soldering portion extending out of the housing. The resilient arm defines a contacting portion projecting into the mating cavity at a front end thereof and a skirt bending from a side edge of the resilient arm and angled with the resilient arm.

Other objects, advantages and novel features of the invention will become more apparent from the following detailed description of the present embodiment when taken in conjunction with the accompanying drawings.

DETAILED DESCRIPTION OF THE INVENTION

Figure 1:
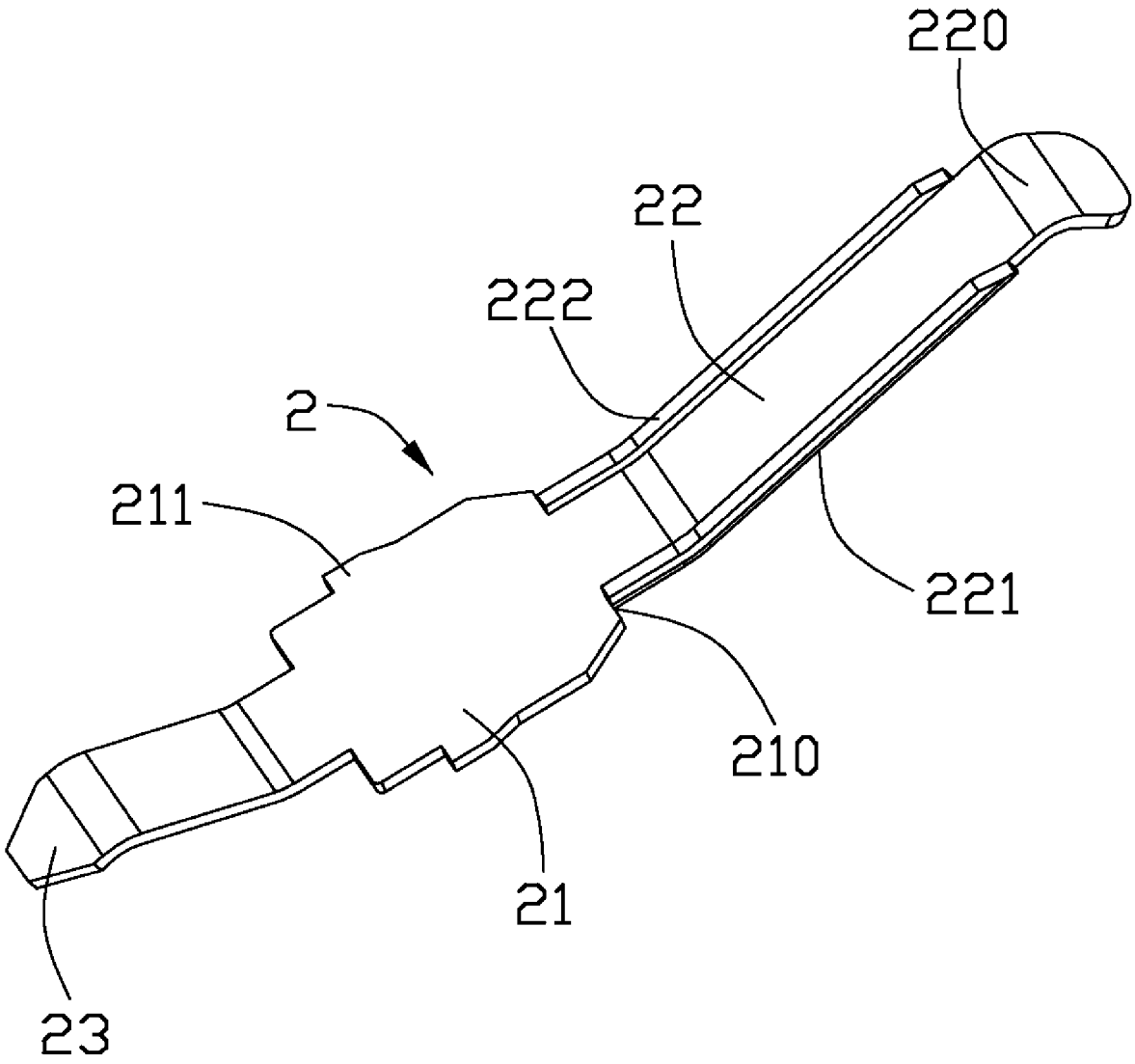
FIG. 1 is a perspective view of a first contact in accordance with the present invention.

Reference will now be made to the drawing figures to describe the preferred embodiment of the present invention in detail.

Figure 2:
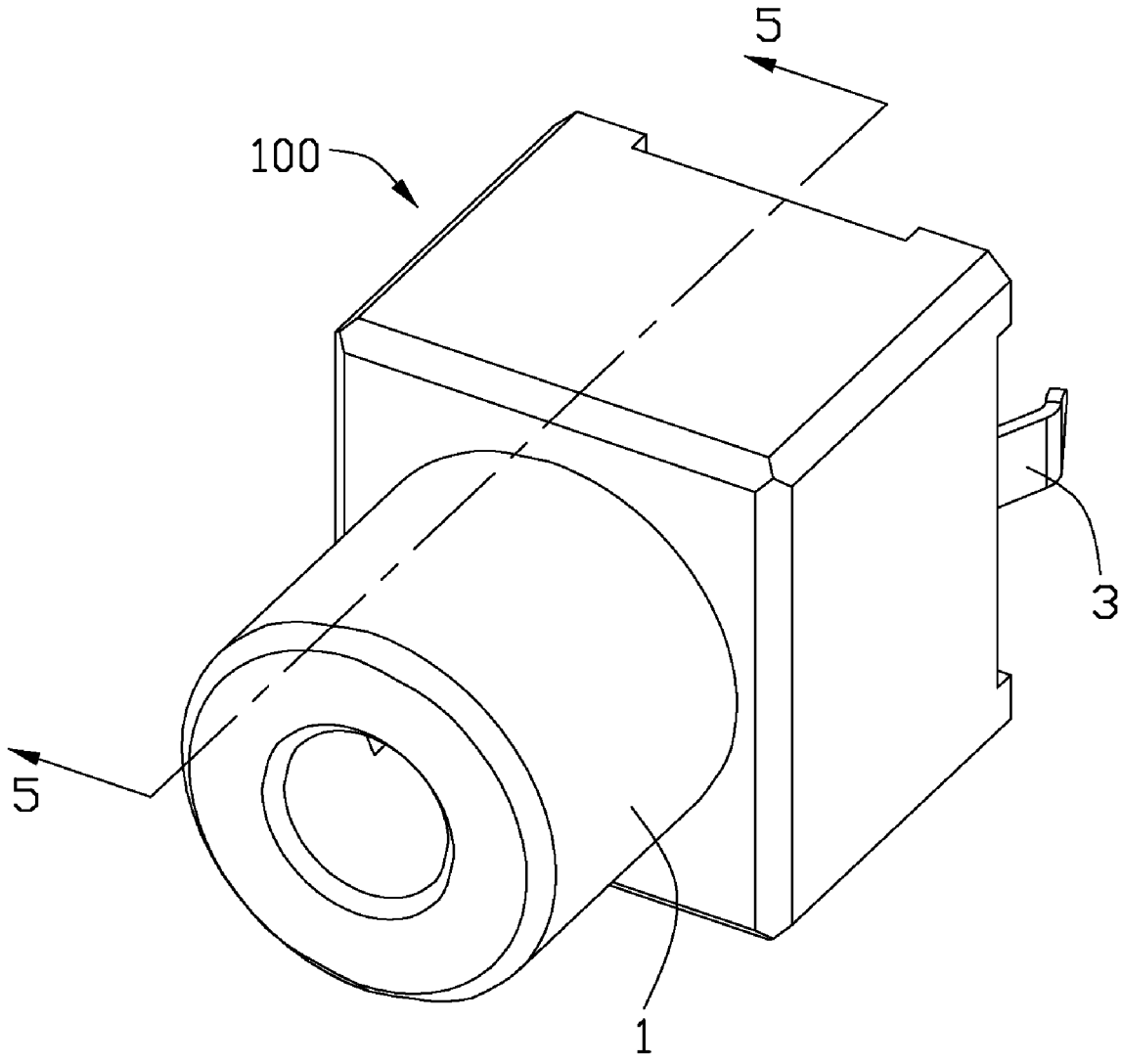
FIG. 2 is an assembled, perspective view of an electrical connector in accordance with the present invention.
Figure 3:
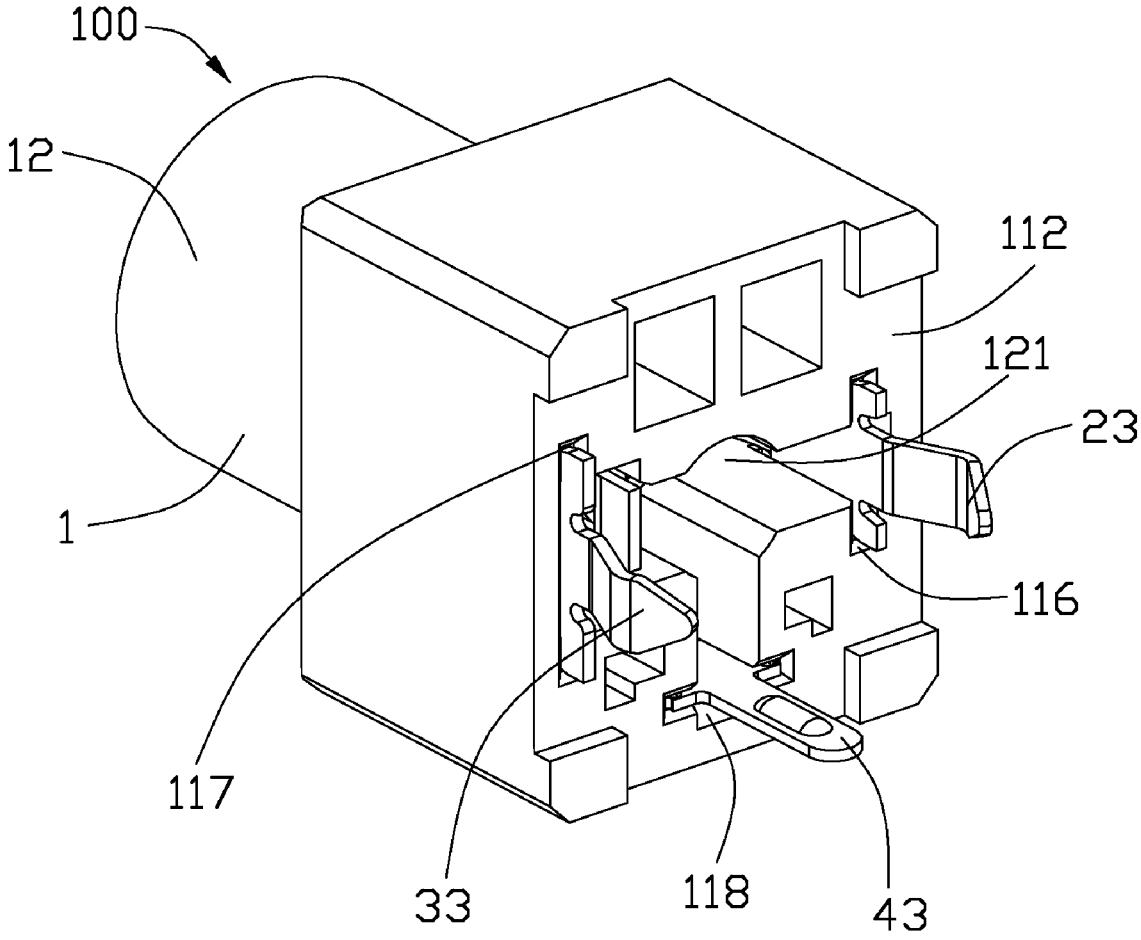
FIG. 3 is another assembled, perspective view of the electrical connector shown in FIG. 2.

Referring to FIG. 1 to FIG. 3, an electrical connector 100 according with the present invention includes an insulative housing 1 and a plurality of contacts retained in the housing 1.

Figure 4:
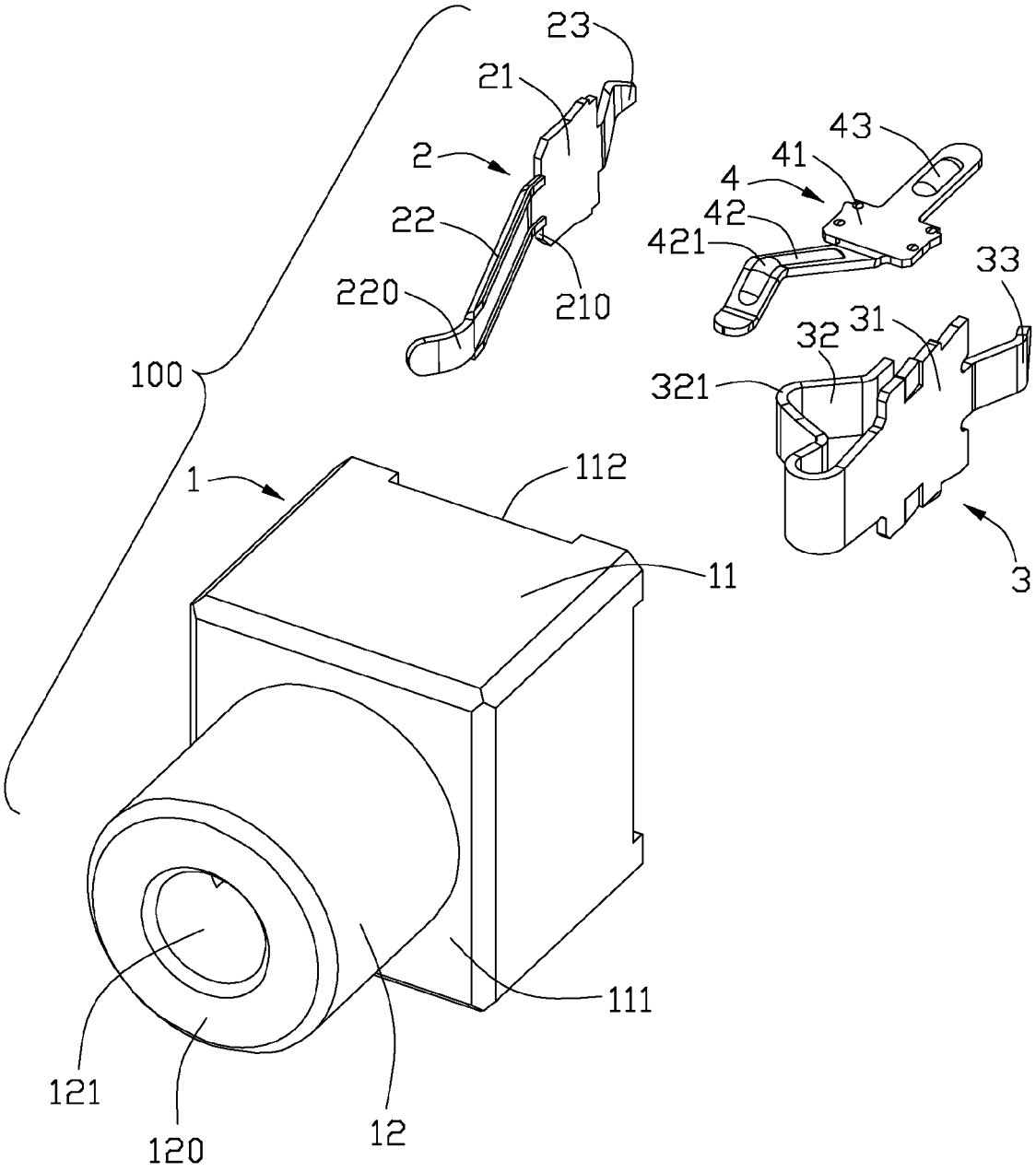
FIG. 4 is an exploded perspective view of the electrical connector shown in FIG. 2.
Figure 5:
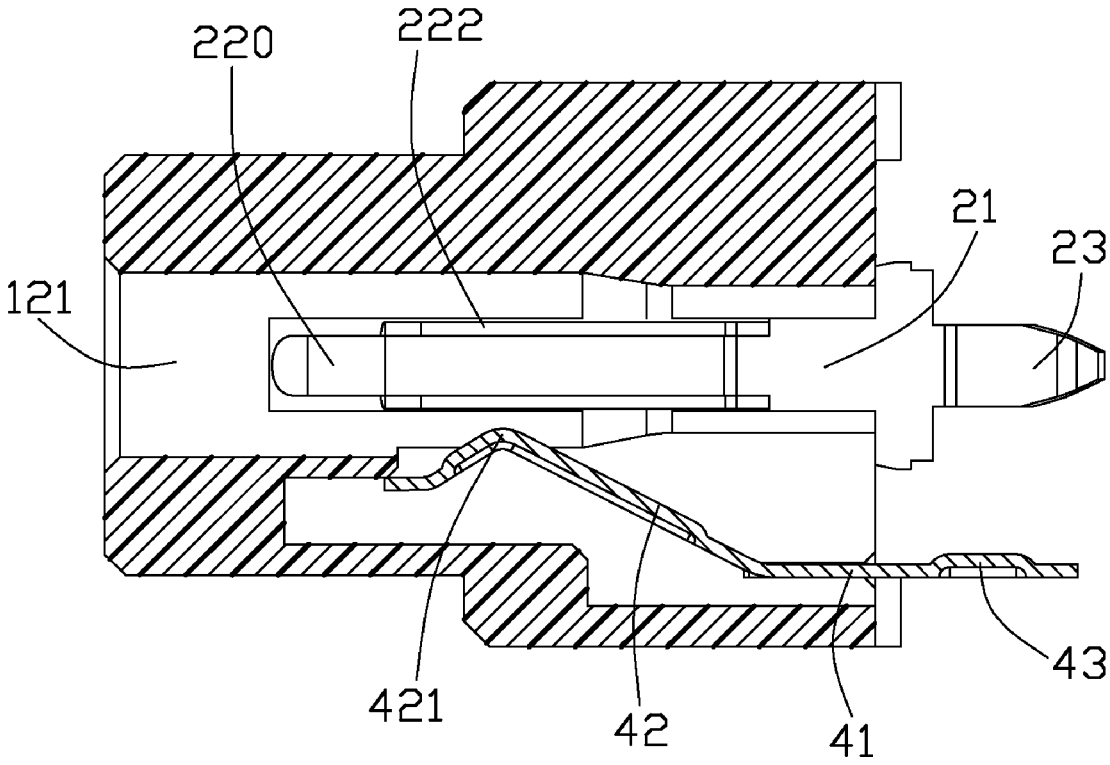
FIG. 5 is a cross-sectional view of the electrical connector taken along line 5-5 of FIG. 2.

Referring to FIG. 3 to FIG. 5, the insulative housing 1 shown in the preferred embodiment includes a rectangular base portion 11 and a cylindrical mating portion 12 extending forwards from a front face 111 of the base portion 11. A mating cavity 121 recesses rearwards from a front face 120 of the mating portion and runs through a rear face 112 of the base portion 11. The base portion 11 is in shape of a rectangular block, and the mating portion 12 is in shape of a cylindrical sleeve. The base portion 11 defines three receiving grooves 116, 117, 118 respectively recess forwards from the rear face 112 thereof and around the mating cavity 121. The first and second receiving grooves 116, 117 are disposed at two sides of the mating cavity 120 and the third receiving groove 118 is disposed under the mating cavity 120, and the three receiving grooves 116, 117, 118 all communicate with the mating cavity 121.

Referring to FIG. 1, and FIG. 3 to FIG. 5, the plurality of contacts defines a first contact 2, a second contact 3 and a third contact 4. The first contact 2 defines a retaining portion 21 with bards 211 projecting outwards from opposite side edges thereof, a resilient arm 22 extending forwards from a front edge 210 of the retaining portion 21 and a soldering portion 23 extending rearwards from a rear edge of the retaining portion 21 opposite to the front edge 210. The resilient arm 22 defines an arc-shaped contacting portion 220 at a free end thereof and two side edges 221 disposed at two opposite sides of the resilient arm 22. The resilient arm 22 defines a side skirt 222 bending sideward from each side edge 221 thereof and angled with the resilient arm 22. In this embodiment, the skirts 222 are disposed at a same side of the resilient arm 22 and each is perpendicular to the resilient arm 22 with an exterior edge at a top portion. The skirt 222 each extends forwards along the side edge 221 from the front edge 210 of the retaining portion 21 to the contacting portion 220 and defines a similar length as the resilient arm 22 in a front-to-rear direction, and the skirt 222 may enhance the intensity of the resilient arm 22. The first contact 2 is received in the housing 1 from the rear face 112 thereof and retained in the first receiving groove 116 by the retaining portion 21 with barbs 211 therein engaging with the first receiving groove 116, and the contacting portion 220 projects into the mating cavity 121 and the skirts 222 face to and project to the mating cavity 121. The soldering portion 23 extends out of the housing 1.

Referring to FIG. 3 to FIG. 5, the second contact 3 defines a flat board-shaped second retaining portion 31, a second resilient arm 32 bending rearwards from a front end of the second retaining portion 31 and a soldering portion 33 extending rearwards from a rear end of the second retaining portion 31. The second resilient arm 32 defines a second contacting portion 321 bent as a V shape. The second contact 3 is received in the housing 1 from the rear face 112 thereof and retained in the second receiving groove 117 by the second retaining portion 31 engaging with the second receiving groove 117, and the second contacting portion 321 projects into the mating cavity 121 and the soldering portion 33 extends out of the housing 1.

The third contact 4 defines a third retaining portion 41, a third resilient arm 42 extending forwardly and upwards from the third retaining portion 41 and providing a third contacting portion 421 at a front end thereof, and a soldering portion 43 extending rearwards from the third retaining portion 41. The third contact 4 is received in the housing 1 from the rear face 112 thereof and retained in the third receiving groove 118 by the third retaining portion 41 engaging with the third receiving groove 118, and the third contacting portion 421 projects into the mating cavity 121 and the soldering portion 43 extends out of the housing 1.

The skirts 222 provided at the resilient arm 22 of the first contact 2 may enhance the rigidity of the resilient arm 22, and the resilient arm 22 having the skirts 222 can be prevented from being crushed while a mating connector frequently mated into and pulled out of the mating cavity 121 or slantways inserted into the mating cavity 121 to press the resilient arm 22. In other embodiment, the second or third resilient arms 32, 42 also can be provided with such skirts to enhance the rigidity of the second or third contacts 3, 4 and prevent the second or third resilient arms 32, 42 from being crushed or destroyed while mating with a mating connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulating housing having a mating cavity; and at least a contact retained in the housing and defining a planar and stiff retaining portion, a resilient arm extending forwards and slantways from a front edge of the retaining portion and a soldering portion extending out of the housing, the resilient arm defining a contacting portion bending into the mating cavity at a front end thereof and a skirt bending from a side edge of the resilient arm and angled with the resilient arm;

wherein the resilient arm having a bend area located between the front edge of the retaining portion and the contacting portion so that at least part of the arm extends slantways from the front edge of the retaining portion, wherein the skirt extends at the front end of the retaining portion along the resilient arm and terminates at the contacting portion to reinforce the strength of the resilient arm and the bend area.

2. The electrical connector as described in claim 1, wherein the skirt is perpendicular to the resilient arm.

3. The electrical connector as described in claim 1, wherein the resilient arm defines two side edges disposed at two opposite sides of the resilient arm, and the skirt is provided at each of side edges.

4. The electrical connector as described in claim 3, wherein the skirts project to the mating cavity.

5. The electrical connector as described in claim 4, wherein the contacting portion is defined as an arc shape.

6. The electrical connector as described in claim 1, wherein the housing defines a base portion and a mating portion extending forwards from the base portion, and the mating cavity recesses rearwards from a front face of the mating portion.

7. The electrical connector as described in claim 6, wherein the base portion is in shape of a rectangular block, and the mating portion is in shape of a cylindrical sleeve.

8. The electrical connector as described in claim 7, wherein the base portion defines a receiving groove communicating with the mating cavity, and the contact is retained in the receiving groove.

9. A contact comprising:

a stiff retaining portion;

a resilient arm extending forwards from a front edge of the retaining portion, the resilient arm defining a first bent region close to the retaining portion, a contacting portion having a second bent region at a free end of the resilient arm and two side edges disposed at two opposite sides of the resilient arm; and a soldering portion extending from a rear edge of the retaining portion;

wherein the resilient arm further defines a skirt bending from at least one of the side edges thereof and angled with the resilient arm;

wherein the skirt extends from the front edge of the retaining portion along the resilient arm, through the first bent region and terminates before reaching the second bent region to reinforce a strength of both the first bent region and the resilient arm disposed between the front edge of the retaining portion and the second bent region.

10. The contact as described in claim 9, wherein the skirt is perpendicular to the resilient arm.

11. The contact as described in claim 10, wherein the contacting portion is defined as an arc shape.

12. An electrical connector comprising:

an insulative housing defining a mating cavity along a mating direction;

a contact disposed in the housing, said contact defining a retaining section retaining to the housing, a cantilevered resilient arm extending from the retaining section along said mating direction and defining a contacting portion projecting into the mating cavity, said resilient arm defining a first bent region with an angled structure thereof, along said mating direction, closer to the retaining section so as to have said resilient arm extend in an angled manner along said mating direction toward the mating cavity; wherein said resilient arm is further equipped with at least a slender skirt extending along a side edge thereof under condition that said skirt extends across said first bent region along said mating direction to reinforce strength of said first bent and around said first bent region during deflection of the resilient arm; wherein the side edge of the resilient arm extends in compliance with said first bent region, and an exterior edge of the slender skirt continuously extends in compliance with the side edge of the resilient arm.

13. The electrical connector as claimed in claim 12, wherein said contacting portion includes a second bent region far from the first bent region, and said skirt terminates before reaching the second bent region.

14. The electrical connector as claimed in claim 13, wherein said first bent region and said second bent region orient in opposite directions.

15. The electrical connector as claimed in claim 14, wherein said resilient arm is further equipped with another slender skirt extending along the other side edge thereof in a symmetrical manner.

16. The electrical connector as claimed in claim 12, wherein said skirt starts at a root of said resilient arm where the resilient arm and the retaining section join with each other.

17. The electrical connector as claimed in claim 12, wherein said skirt is essentially of a flange structure with regard to the resilient arm.

18. The electrical connector as claimed in claim 12, wherein the first bent region is angled inwardly while the resilient arm is deflectable outwardly.

* * * * *